US010485734B2

(12) United States Patent
Bentkovski et al.

(10) Patent No.: US 10,485,734 B2
(45) Date of Patent: Nov. 26, 2019

(54) APPARATUS AND METHOD FOR SENDING REMINDERS TO A USER

(71) Applicant: WATERIO LTD., Ness Ziona (IL)

(72) Inventors: Yakov Bentkovski, Ness-Ziona (IL); Nimrod Kaplan, Ness Ziona (IL)

( * ) Notice: Subject to any disclaimer, the term of this patent is extended or adjusted under 35 U.S.C. 154(b) by 0 days.

(21) Appl. No.: 16/073,810

(22) PCT Filed: Jan. 31, 2017

(86) PCT No.: PCT/IL2017/050114
§ 371 (c)(1),
(2) Date: Jul. 30, 2018

(87) PCT Pub. No.: WO2017/130207
PCT Pub. Date: Aug. 3, 2017

(65) Prior Publication Data

US 2019/0038513 A1 Feb. 7, 2019

Related U.S. Application Data

(60) Provisional application No. 62/344,619, filed on Jun. 2, 2016, provisional application No. 62/289,257, filed on Jan. 31, 2016.

(51) Int. Cl.
*A61J 7/04* (2006.01)
*A61J 1/03* (2006.01)

(52) U.S. Cl.
CPC ..... *A61J 7/0436* (2015.05); *A61J 1/035* (2013.01); *A61J 7/0481* (2013.01); *A61J 2200/30* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,616,316 | A | 10/1986 | Hanpeter et al. | |
| 2001/0016059 | A1* | 8/2001 | Krahn | G01N 21/9508 382/141 |
| 2004/0050746 | A1 | 3/2004 | Dunlop et al. | |
| 2006/0109123 | A1* | 5/2006 | Carrender | G06K 19/0723 340/572.1 |
| 2007/0265730 | A1* | 11/2007 | Greyshock | G06K 7/14 700/236 |
| 2009/0065522 | A1* | 3/2009 | Benouali | A61J 1/035 221/7 |
| 2011/0166698 | A1* | 7/2011 | Vallone | G06F 19/3462 700/233 |
| 2016/0026773 | A1* | 1/2016 | Chu | A61J 1/03 705/2 |
| 2017/0046501 | A1* | 2/2017 | Coleman | A61J 1/035 |

* cited by examiner

*Primary Examiner* — Nabil H Syed
*Assistant Examiner* — Cal J Eustaquio
(74) *Attorney, Agent, or Firm* — Wayne V. Harper

(57) ABSTRACT

The invention is related to an apparatus that includes: a housing attachable to a blister pack, at least one sensor attached to the housing and capable of sensing removal of a pill from an attached blister pack and a controller. The controller is configured to: determine a timing parameter for taking a pill, receive from the at least one sensor a signal, determine based on the signal if a pill was removed from the blister pack, and if a pill was not removed from the blister pack within a time period based on the timing parameter issue to an output unit a reminder signal for taking the pill.

21 Claims, 7 Drawing Sheets

APPARATUS AND METHOD FOR SENDING REMINDERS TO A USER

BACKGROUND OF THE INVENTION

One of the most common problems associated with adherence of medication is the failure to take pills on time. Often, a person simply forgets to take a pill when the appropriate time comes. Sometimes a person forgets when he or she has taken their last pill. The problem become more severe as the person gets older. Some elderly people had to take several medications during a day at different time, finds it hard to remember which medication to take at which time, as remembering capabilities are reduced with age.

Market available systems are generally timer-based, so as to remind users to take pills solely or predominantly based on setting a timer. However, such systems do not observe or record the removal of pills from the blister pack. Therefore, there is a need of an electronic system for monitoring and reminding intake of pills.

SUMMARY OF THE INVENTION

Embodiments of the invention are related to an apparatus for issuing a reminder to a user to take a pill that may include: a housing attachable to a blister pack, at least one sensor attached to the housing and capable of sensing removal of a pill from an attached blister pack and a controller. The controller may be configured to: determine a timing parameter for taking a pill, receive from the at least one sensor a signal, determine based on the signal if a pill was removed from the blister pack, and if a pill was not removed from the blister pack within a time period based on the timing parameter issue to an output unit a reminder signal for taking the pill.

Embodiments of the invention are related to a computer implemented method of issuing a remainder to a user to take a pill, to be executed by a processor. The method may include determining a timing parameter for taking a pill, receiving from at least one sensor a signal, at least one sensor is capable of sensing removal of a pill from a blister pack, determining based on the signal if a pill was removed from the blister pack and if a pill was not removed from the blister pack within a time period based on the timing parameter issuing to an output unit a reminder signal for taking the pill.

Other features of the invention will be evident from the specification and figures.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
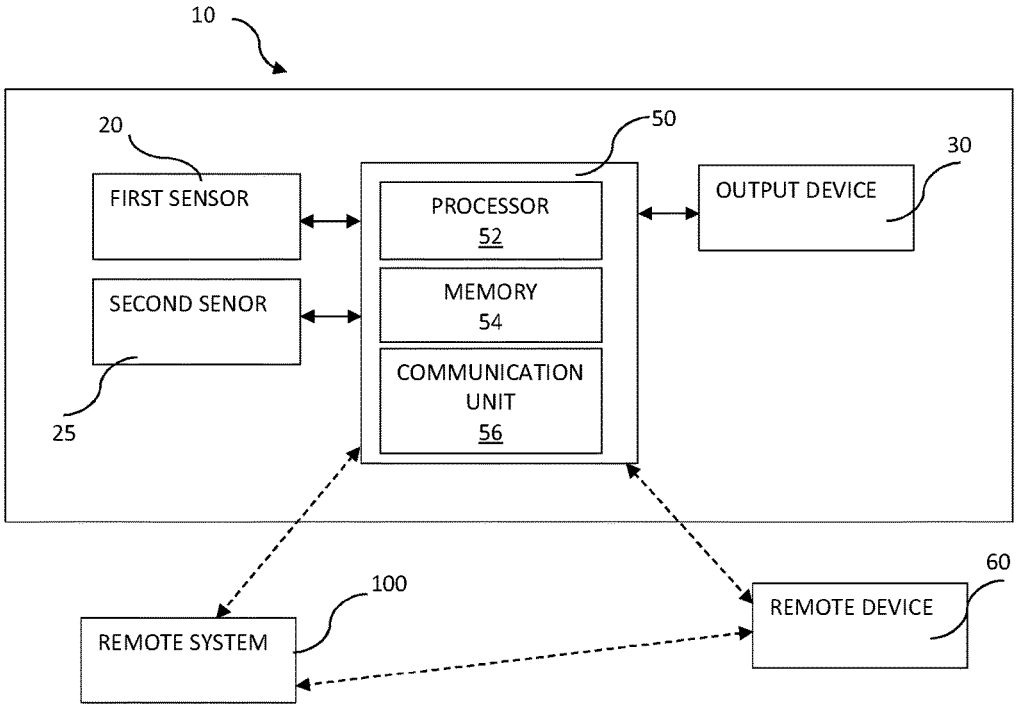
FIG. 1 is a high level block diagram of an apparatus for issuing a reminder according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

Although embodiments of the invention are not limited in this regard, discussions utilizing terms such as, for example, "processing," "computing," "predicting", "calculating," "determining," "establishing", "analyzing", "checking", "manipulating", "filtering" or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

Some embodiments of the invention are related to an apparatus and a method for issuing reminders to users to take a pill out of a blister pack, according to some embodiments of the invention. The apparatus may be configured to be simply attached and detached from the blister pack, for example, the apparatus may be attached to the blister pack by a pharmacist providing the pills, a caregiver or the user himself. The apparatus may include an output device such as a speaker, one or more lights, a vibrating element etc., for providing a reminder signal to the user, when the time has come to take the pill. The device may further include one or more sensors for detecting if the user had taken the pill one time (or within an acceptable interval of time) or should be reminded again. In some embodiments, the reminder signal may appear on a user device, such as, a smartphone, smart watch, or other remote device (e.g., central monitoring device of a hospital or medical monitoring facility). In some embodiments, the apparatus may be configured to issue reminder signals for each of the pills in a blister pack according to the prescription of the pills given to the user.

Reference is now made to FIG. 1 which is high level block diagram of an apparatus for issuing a reminder according to some embodiments of the invention. An apparatus 10 may include at least a first sensor 20 and a second sensor 25 capable of sensing removal of a pill from a blister pack, an output device 30 and a controller 50. Apparatus 10 may be configured to communicate with a remote device 60, for example, via a communication unit 56. Remote device 60, may be a mobile device such as, smartphone, tablet and the like, or may be a personal device such as a lap-top or a PC. Remote device 60 may be operated by the user taking the pills, a caregiver, a health-provider (e.g., doctor) supervising the medical treatment of the user and the like.

First sensor 20 and a second sensor 25 may be any sensor(s) that are configured to sense or detect removal of a pill from a blister pack. For example, sensors 20 and/or 25 may be cameras illustrated and discussed with respect to FIGS. 2A-2D and/or sensor 27, illustrated in FIG. 2D. In another example, sensors 20 and/or 25 may include one or more electrical circuit illustrated and discussed with respect to FIGS. 3A-3B. In yet another example, sensors 20 and/or 25 may be or may include, capacitance sensor, inductance sensor or other suitable sensors.

In some embodiments, device 10 may further include an attachment sensor (not illustrated) for detecting the attachment of device 10 to blister pack 5. The attachment sensor may be or may include a switch, an electrical circuit or any suitable element. Upon attachment of device 10 to blister pack 5, the attachment sensor may send an initiation signal to controller 50 or any other external processor.

Output device 30 may be or may include, one or more: light sources (e.g., LED lamps), a loudspeaker, a vibrating device, a display or the like. Each of the elements of output device 30 may be configure to signal the user. In some embodiments, output device 30 may be a display in remote device 60 configured to display a reminder signal to the user, for example, a note saying "please take the pill".

In some embodiments, controller 50 may include a processor 52 (e.g., a chip), a memory 54 and a communication unit 56. Memory 54 may include a Random Access Memory (RAM), a read only memory (ROM), a Dynamic RAM (DRAM), a Synchronous DRAM (SD-RAM), a double data rate (DDR) memory chip, a Flash memory, a volatile memory, a cache memory, a buffer, a short term memory unit, a long term memory unit, or other suitable memory units or storage units. Memory 52 may store one or more executable codes to be executed by processor 52, for example, codes for receiving a signal indicating removal of a first pill from the blister pack from sensors 20 and/or 25. The code may further include determining a timing parameter. The code may include receiving additional data from one or more input devices 40. The code may include issue to output unit 30 a reminder signal for taking a second pill. It will be understood that FIG. 1 is a high-level schematic figure, and some functional modules, e.g., memory and processing, may reside in a single physical device.

In some embodiments, communication unit 56 may be configured to communicate with remote device 60 (e.g., a smart phone, a tablet, a smartwatch, a laptop, a PC, etc.) or any external computing device, using any known protocol, for example, Bluetooth, Wi-Fi, and the like. In some embodiments, memory 54 may store identification information of device 10 to be recognized by remote device 60 when establishing the communication.

Figure 2A:
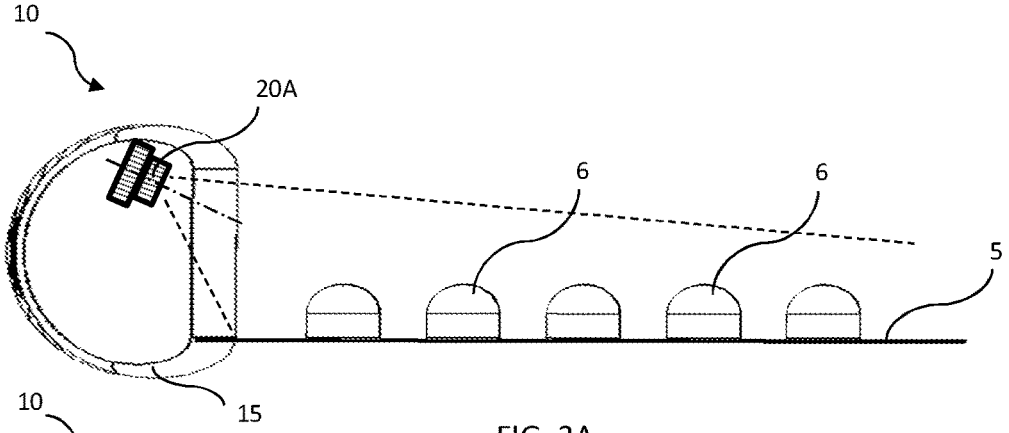
FIGS. 2A-2D are illustrations of apparatus for issuing a reminder that includes at least one camera according to some embodiments of the invention.
Figure 2B:
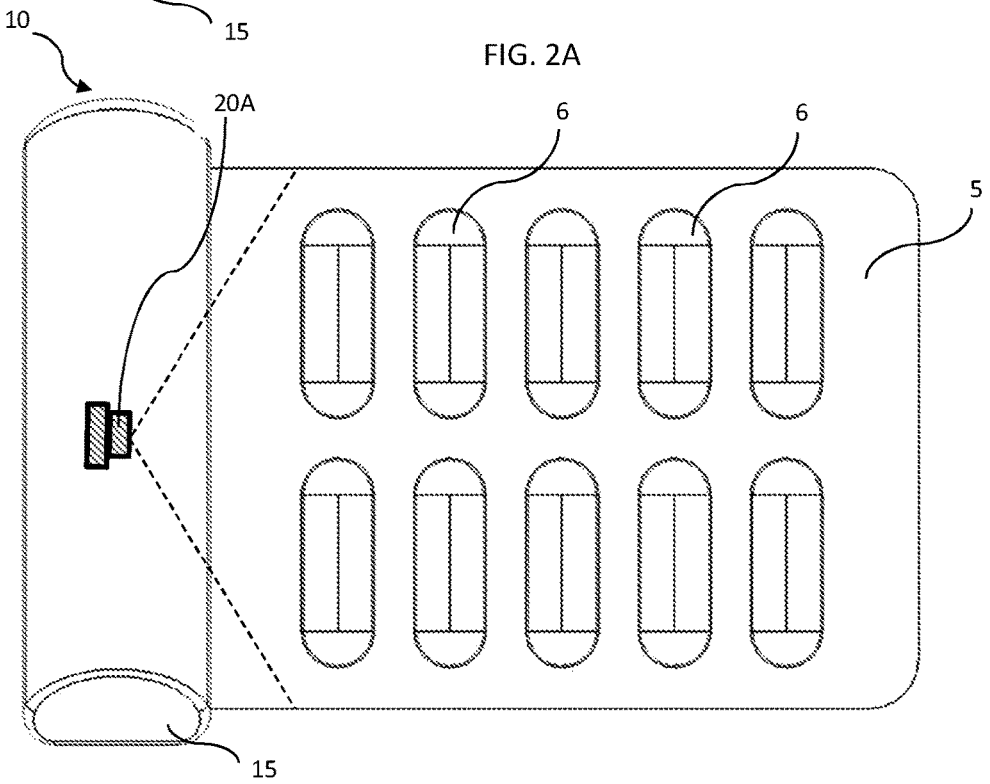
Figure 2C:
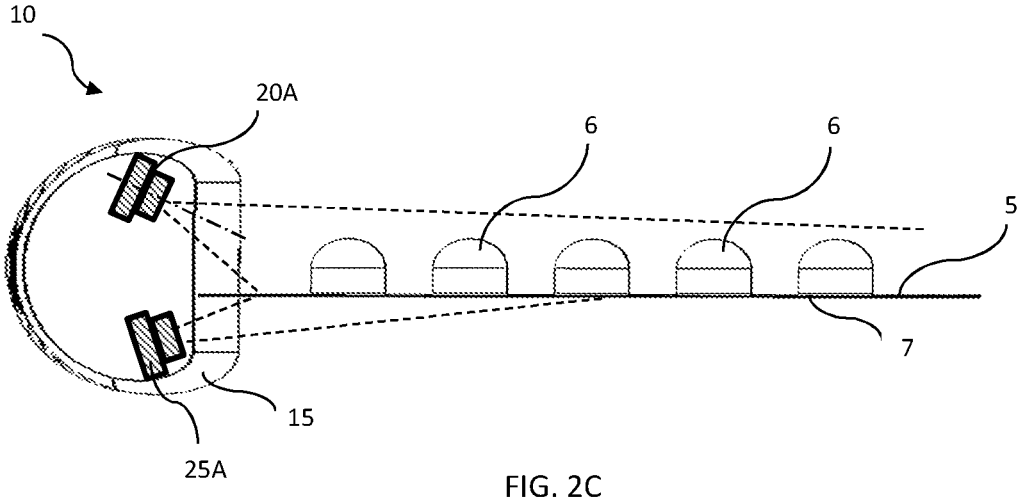
Figure 2D:
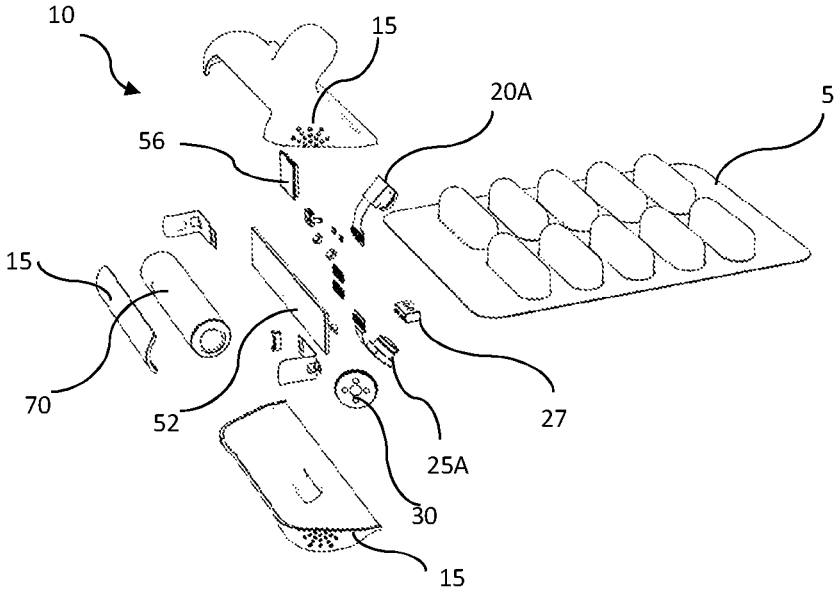

In some embodiments, apparatus 10 may further include a power supply (not illustrated), for example, a battery 70 illustrated in FIG. 2D. Reference is now made to FIGS. 2A-2D that include illustrations of devices for issuing a reminder signal according to some embodiments of the invention. Devices 10 illustrated FIGS. 2A-2D include a housing 15 attachable to a blister pack 5 and at least one camera 20A and 25A attached to housing 10 and capable of sensing removal of a pill 6 from attached blister pack 5. Housing 15 may be configured to hold at least some of the components of apparatus 10, for example, sensors 20, 25, output unit 30 and controller 50, illustrated in FIG. 1.

FIGS. 2A and 2B are illustrations of a side view and a top view of a device 10 having a first sensor, a camera 20A. The field of view (FOV) of camera 20A is defined by the dashed lines showing that camera 20A can capture image of the entire blister pack 5 and all pills 6, as shown in the image in FIG. 5A taken by such camera. The image may further be processed using any suitable image processing algorithm, for example, as shown in FIG. 5B. The processing may be conducted by processor 52, the processor of remote device 60 and/or a remote processor, such as processor 112, illustrated in FIG. 4.

It will be understood that after being captured by the imager, the image may be compressed prior to storage or transmission to a remote device. Moreover, it will further be understood that image processing steps may be performed on the apparatus or on a remote device, all such embodiments being within the scope of the invention.

FIGS. 2C and 2D are illustrations of a side view of an assembled device 10 and an isometric view of the main components included in device 10 according to some embodiments of the invention. Devices 10 illustrated in FIGS. 2C and 2D includes a first sensor, a camera 20A and a second sensor, a camera 25A. In some embodiments, device 10 may further include a third sensor, for example, an additional sensor 27 (e.g., an optical sensor) illustrated in FIG. 2D. FIG. 2C shows the FOV of both cameras 20A and 25A covering both sides of blister 5, when camera 20A capture the side of pills 6 and camera 25A capture the side of a tearable foil 7. In some embodiments, camera 20A may be configured to detect a removal of a pill from blister pack 5 and camera 25A may be configure to capture an image of tearable foil 7 that may include printed or other information related to the type of pills, for example, a descriptive name or trade name of the pills (e.g., Advil©), that may allow a processor, such as processor 52, the processor of remote device 60 or other networked processor receiving the image, to identify the type of pills 6 in blister 5. In some embodiments, apparatus 10 may further include lighting source(s) for capturing images of blister pack 5 at different lightening conditions. The light source may be, for example, visible light source, IR light source, UV light source and the like.

FIG. 2D is a detailed illustration of some components of device 10. Device 10 illustrated in FIG. 2D may include a first camera 20A and a second camera 25A. The device may further include an additional sensor 27, for example, an optical sensor or camera, an IR camera, an RFID reader, e.g., near field communication (NFC), UV sensor and the like.

The device may include a housing 15. Housing 15 may be assembled from multiple parts (e.g., two parts, as illustrated). Apparatus 10 may further include a processor 52, a communication unit 65 an output unit 30 (e.g., a speaker) and a battery 70.

Figure 3A:
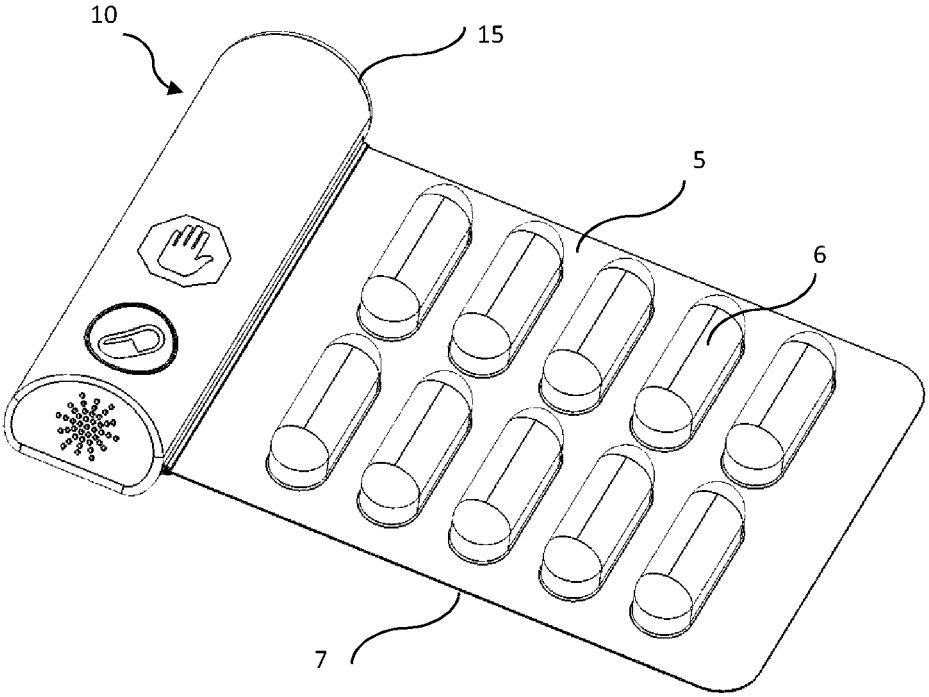
FIGS. 3A-3B are illustrations of apparatuses according to some embodiments of the invention for issuing a reminder.
Figure 3B:
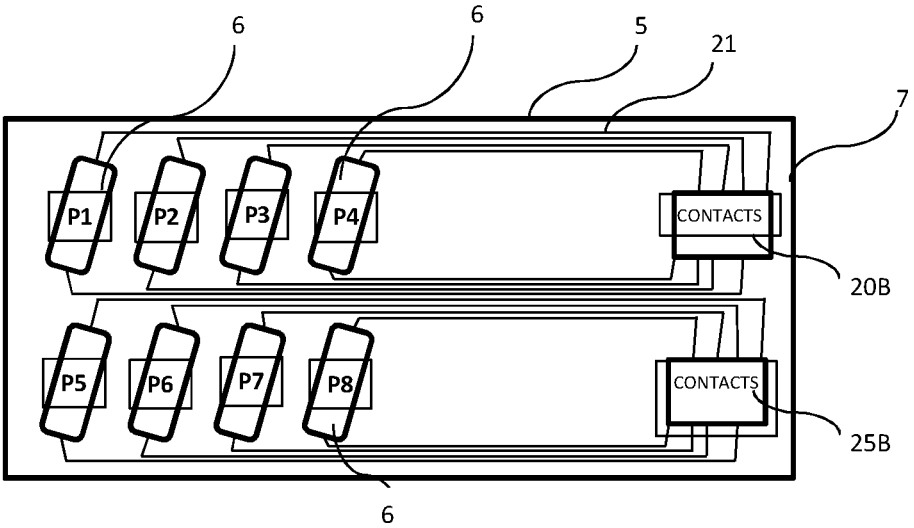

Reference is now made to FIGS. 3A and 3B, in which FIG. 3A is an isometric view of device 10 and an attached blister pack, and FIG. 3B is a bottom view of a blister pack according to embodiments of the invention may be attached to device 10.

Device 10 of FIG. 3A may include a housing 15 and at least one first sensor 20B that may include at least one electrical circuit comprising a conducting line 21. First sensor 20B may be configured to detect removal of a pill from the blister when at least one conducting line 21 in the blister pack is disconnected due to removal of pill 6 from tearable foil 7. In some embodiments, each pill 6 in blister pack 5 may be connected to an independent circuit as illustrated in FIG. 3B. Alternatively, First sensor 20B may be connected to a matrix of conducting lines that can detect tears in at least some of the conducting lines upon a removal of pill 6 from blister pack 5. In some embodiments, device 10 may include a second sensor 25B connected to at least one conducting line, as illustrated in FIG. 3B. First sensor 20A may detect the removal of pills 6 in the upper portion of blister pack 5 and second sensor 25B may detect the removal of pills 6 from the lower portion of blister pack 5.

Figure 4:
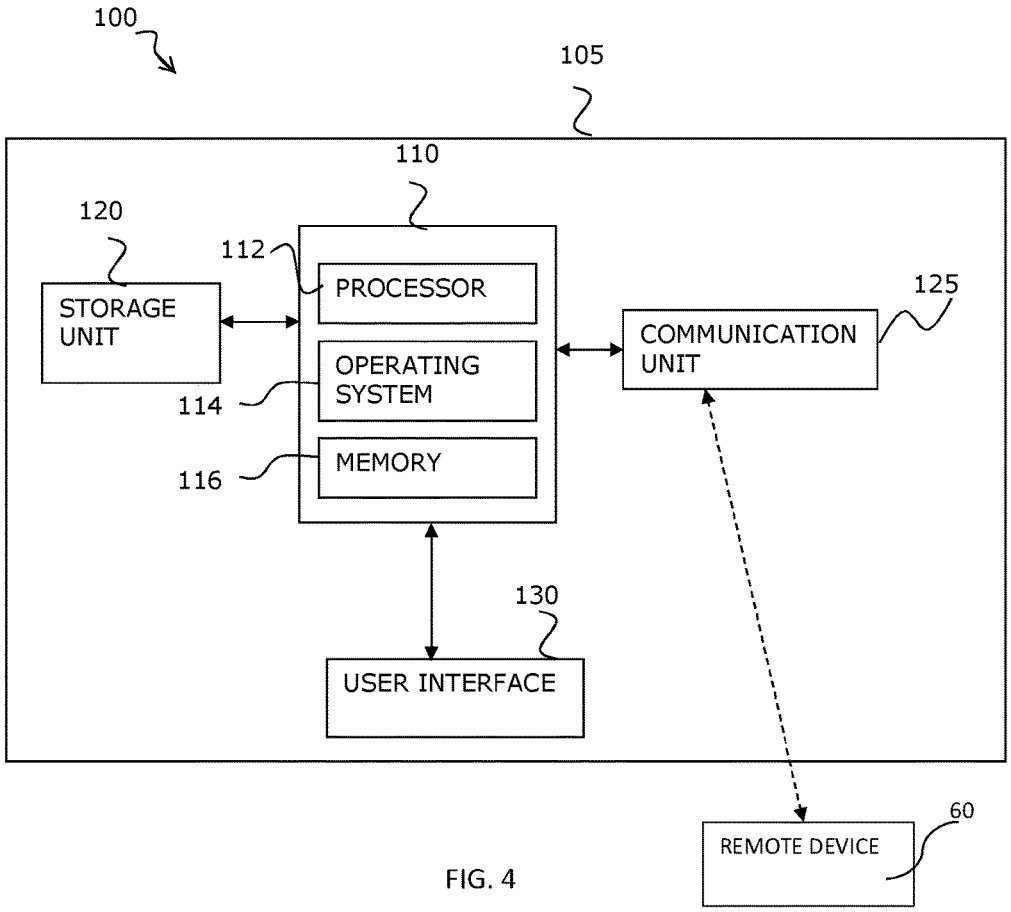
FIG. 4 is a high level block diagram of a system according to some embodiments of the invention for issuing a reminder to take a pill.
Figure 5A:
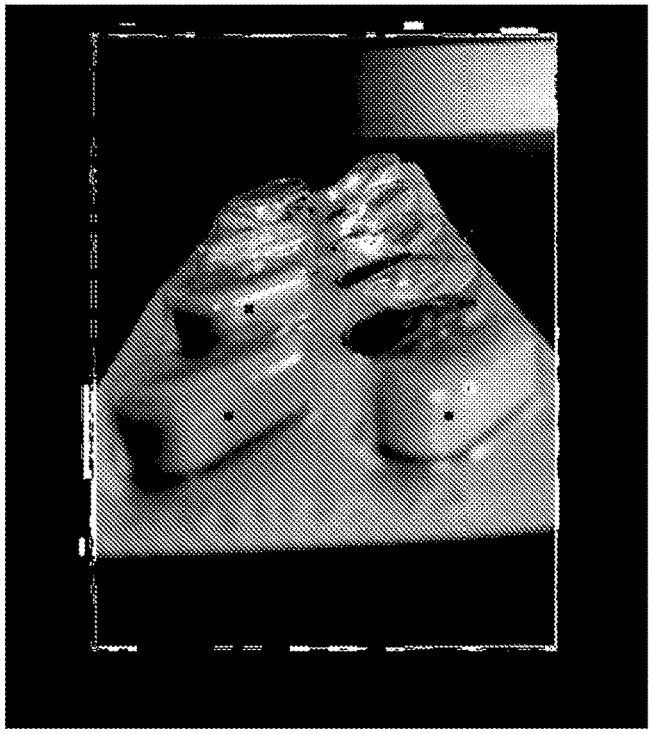
FIGS. 5A and 5B are images of a blister pack taken by an apparatus according to some embodiments of the invention.
Figure 5B:
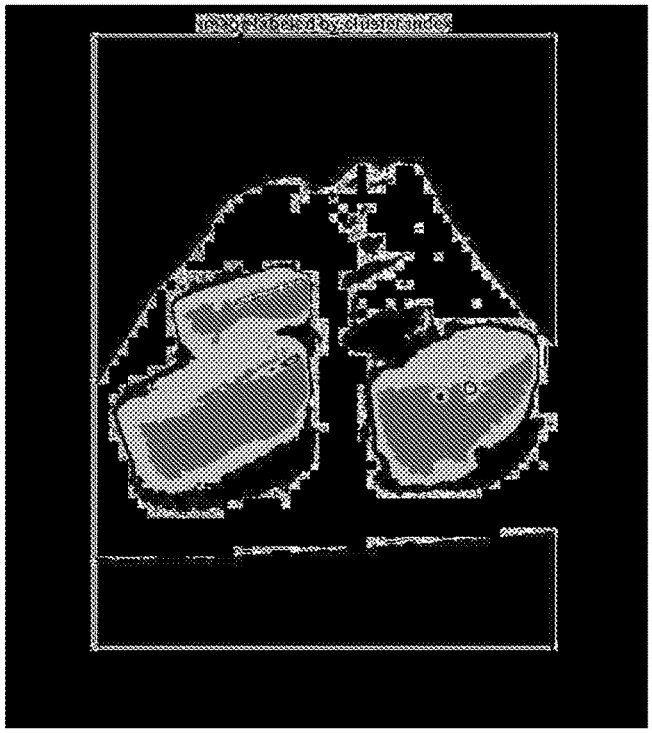

Reference is now made to FIG. 4 which is a high level block diagram of a system for issuing a reminder to a user according to some embodiments of then invention. A system 100 may include a server 105 that may be, for example, a cloud base server or a physical processing unit. Server 105 may include processing device 110, a storage unit 120, a user interface 130 and a communication unit 125. Processing unit 110 may include a processor 112 that may be, for example, a central processing unit (CPU), a chip or any suitable computing or computational device, an operating system 114 and a memory 116. Processor 112 may be configured to carry out methods according to embodiments of the present invention by for example executing instructions stored in a memory such as memory 116. Operating system 114 may be or may include any code segment designed and/or configured to perform tasks involving coordination, scheduling, arbitration, supervising, controlling or otherwise managing operation of processing device 110, for example, scheduling execution of programs. Operating system 114 may be a commercial operating system. Memory 116 may be or may include, for example, a Random Access Memory (RAM), a read only memory (ROM), a Dynamic RAM (DRAM), a Synchronous DRAM (SD-RAM), a double data rate (DDR) memory chip, a Flash memory, a volatile memory, a non-volatile memory, a cache memory, a buffer, a short term memory unit, a long term memory unit, or other suitable memory units or storage units. Memory 116 may be or may include a plurality of, possibly different memory units.

Memory 116 may store any executable code, e.g., an application, a program, a process, task or script. The executable code may include instructions for processing information such as images and other data received from the at least one sensor 20, 20A, 20B or 25, 25A, 25B, and 27 (e.g., a remote sensor), via communication unit 125, a signal indicating removal of a pill and determining a timing parameter. The code may further include instructions to issue reminder signals. The executable code may be executed by processor 112 possibly under control of operating system 114.

Storage 120 may be or may include, for example, a hard disk drive, a floppy disk drive, a Compact Disk (CD) drive, a CD-Recordable (CD-R) drive, a universal serial bus (USB) device or other suitable removable and/or fixed storage unit. Content, such as historical data related to detection of pills removal and the time of the removal of the pills, may be stored in storage 120 and may be loaded from storage 120 into memory 116 where it may be processed by processor 112.

User interface 130 may be or may include any device configured to receive inputs from a user (e.g., an administrator) and display outputs to the user. For example, user interface 130 may include, a screen, a keyboard, a pointing device, an audio device, or any applicable input/output (I/O) devices may be connected to processing unit 110.

Communication unit 125 may include any wired or wireless network interface card (NIC) that may allow processing unit 110 to communicate with external devices such as remote device 60 and/or device 10, for example, over the internet.

In some embodiments, system 100 may be included in remote device 60 and processor 112 may be a processor included in remote device 60.

Figure 6:
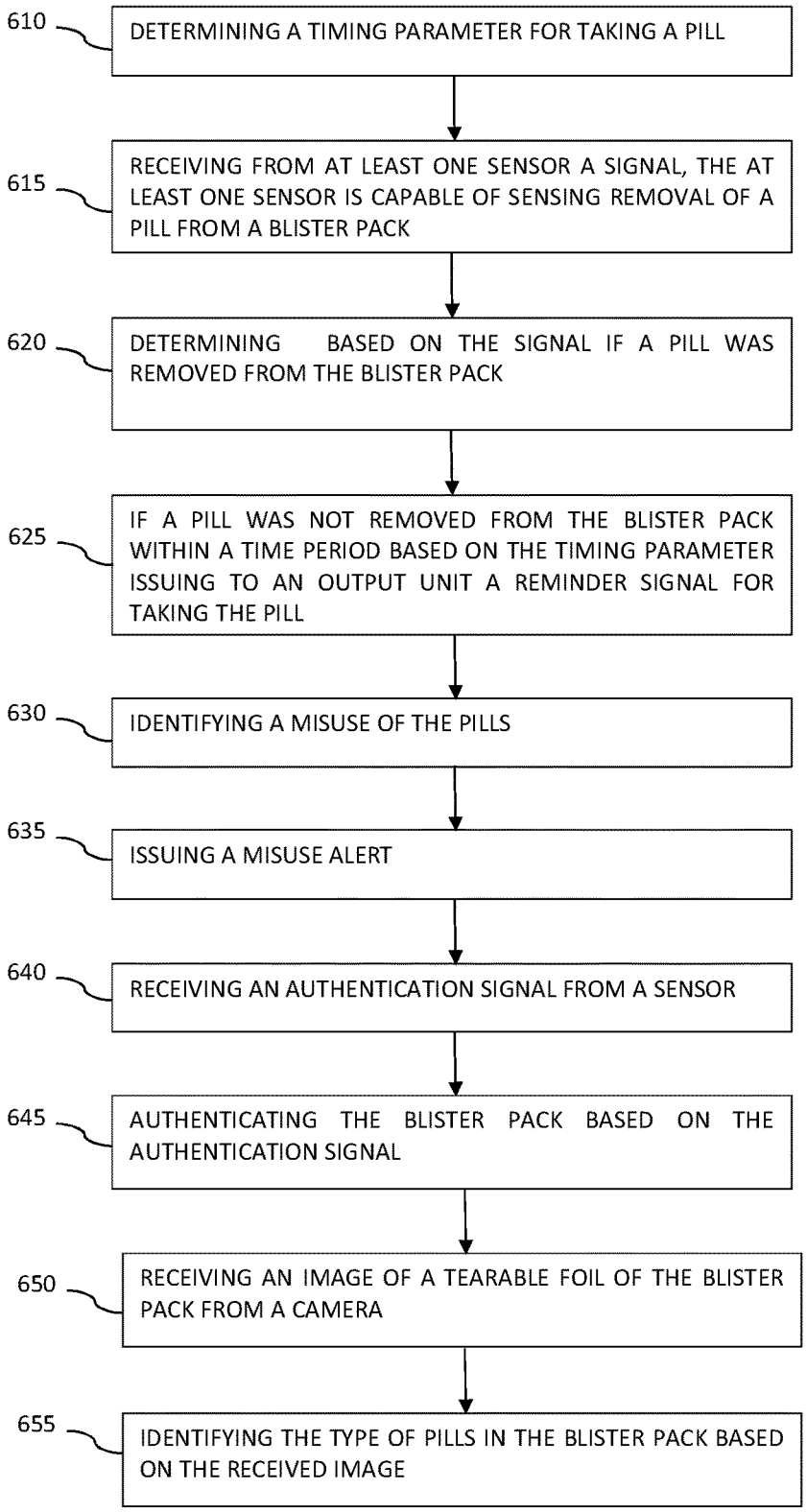
FIG. 6 is a flowchart of a method of issuing a reminder to take a pill according to some embodiments of the invention.

Reference is now made to FIG. 6 which is a flowchart of a method of issuing a reminder to a user according to some embodiments of the invention. The method of FIG. 6 may be performed (e.g., executed) by at least one of processor 52 of apparatus 10, the processor of remote device 60 and processing unit 112 of system 100. In some embodiments, all the operations of the method of FIG. 6 may be performed by a single processor. In some embodiments, some of the operations of the method of FIG. 6 may be performed by a first processor (e.g., processor 52 or the processor of remote device) and other operations may be performed by a second processor (e.g., processing unit 112).

In operation 610, embodiments may include determining a timing parameter for taking at least one pill. The timing parameter may include a starting time for taking one or more pills 6, a time interval between taking a first pill and a second pill (e.g., 6 hours), an allowed delay time in taking a pill (e.g., 15 minutes) and the like. In some embodiments, an additional information (e.g., a prescription) may be received from a remote device 60 (e.g., supplied by the user, the caregiver, a doctor, a family member and the like.

In some embodiments, the method may further include receiving pills related data, (e.g., a prescription) for example, the type of pills, a numbers of pills to be taken in a day, a time in the day for taking at least one pill and/or a number of pills to be taken each time and determining the timing parameter may be based on the pills related data. In some embodiments, the method may further include receiving user related data, for example, age, gender, illness, other medications taken by the user and the like, and determining the timing parameter may be based on the user related data. In some embodiments, receiving the pills related data and/or the user related data may be from at least one of: remote device 60, a data base (e.g., storage using 120) and a readable element associated with the blister pack (e.g., a chip/RFID and the like). For example, the user related data may include an information that user already takes one pill of a first type every morning, and the pills related data may include a prescription to take one pill of a second type each day. Accordingly, the processor may determine that the user may take the pill of the second type every evening.

In some embodiments, the method may further include receiving from a database (e.g., storage using 120) two or more historical signals indicating a removal of pills from a blister by a specific user at specific times and determining the timing parameter based on the received two or more historical signals. For example, if the historical signal indicates that the user prefers to take the pills at 20:00 (e.g., after dinner) the timing parameter may include a note for taking a pill between 19:54-20:15. In some embodiments, the processor may continuously analyze of the historical signals indicating a removal of pills from a blister by a specific user, and iteratively learn the 'time frames' for issuing the reminders, for example, to avoid annoying the user.

In some embodiment, the method may further include receiving an initiation signal and determine the timing parameter also based on the initiation signal. In some embodiments receiving the initiation signal is upon attachment of the apparatus to the blister pack. For example, the initiation signal may be received from an attachment sensor included in the apparatus (e.g., a switch and electrical circuit, and the like). In yet another example, the initiation signal may be an image of the blister received from a camera (e.g., camera 25A). In operation 615, embodiments may include receiving from at least one sensor a signal, the at least one sensor is capable of sensing removal of a pill from a blister pack. For example, the signal may be an image of the blister pack received from at least one camera (e.g., camera 20A and 25A), for example, the image in FIG. 5A. The method may further include processing the image to detect if a pill was taken from the blister pack, for example, as shown in FIG. 5B. The processor may use any image processing algorithm to analyze the taken image, for example, by comparing the image to a previously taken image from the same blister pack and identify if a pill was taken from the blister pack.

In yet another example, the signal may be include an indication for disconnection of at least one electrical circuit included in a sensor (e.g., sensor 20B or 25B) that may include a device for sensing disconnection in one or more conducting lines (e.g., lines 21) in the electrical circuit, attached to a tearable foil (e.g., foil 7) of blister pack 5.

In some embodiments, the signal may be received from other sensors, for example, a touch sensor, a movement detecting sensor (e.g., an accelerometer) and the like.

In operation 620, embodiments may include determining based on the signal if a pill was removed from the blister pack. In some embodiments, if the timing parameter indicate that a time for taking a pill has arrived, the processor may receive form the sensor the signal. For example, if the time for taking the pill (e.g., 20.00) has arrived the processor may determine whether at least one additional conducting line 21 was disconnected or whether the image (e.g., the image of FIG. 5A) shows that an additional pill was removed. In such case the processor may determine that such additional pill was taken and no further acts should be taken at this stage.

In operation 625, embodiments may include issuing to an output unit a reminder signal for taking the pill, if a pill was not removed from the blister pack within a time period based on the timing parameter. For example, if no signal indicating that a pill was taken until 20:15 (e.g., when the timing parameter includes 15 minutes of delay) was received, the processor may issue to an output unit a reminder signal for taking the pill. In some embodiments, the reminder signal may be selected from a group consisting of: audio signal, light signal, vibration and displaying a notification on a display, for example, of a user device. In some embodiments, the output unit may be output device 30 of apparatus 10, an output unit included in remote device 60 and the like.

In operation 630, embodiments may include identifying a misuse of the pills. For example, a signal may indicate that two pills instead of one were taken from the blister pack at substantially the same time, or that a time interval between taking two consecutive pills was shorter than the one determined using the timing parameter. In such case a suspected misuse of the blister pack may be determined by the processor and embodiments may further include, in operation 635, issuing a misuse alert. An alert may be issued and send to a remote device. In some embodiments, issuing a misuse alert may include sending a notification to a user, sending a notification to a caregiver of the user via the apparatus or a remote device, sending a notification to a relative of the user and/or sending a notification to a healthcare organization.

In operation 640, embodiments may include receiving an authentication signal from a sensor. The sensor may be sensor 20, 20A, 25 or 25A included in device 10 or may be an additional sensor such as sensor 27. For example, sensor 27 may be a camera, a UV sensor or other type of optical sensor, and the authentication signal may include an optical/UV marking such as an image that includes authentication information, such as barcode, serial number and the like. In yet another example, sensor 27 may be an RFID reader and the signal may include authenticating RF signal received from an RFID tag attached to the blister pack. In operation 645, embodiments may include authenticating the blister pack based on the authentication signal. For example, a signal comprising a barcode, a serial number or an RFID may be compared to a list of authenticated data stored in a database, for example, storage unit 120.

In operation 650, embodiments may include receiving an image of a tearable foil of the blister pack from a camera. For example, camera, such as camera 25A may capture the image of tearable foil 7, for example, an image that includes information such as the name or the logo of the pills, for example, Advil©. In operation 655, embodiments may include identifying the type of pills in the blister pack based on the received image. For example, the image taken by camera 25A may be compared with images or logos of registered medications for identifying the type of pills in the blister pack.

It will be understood that in some embodiments, the order or steps may be different. For example, the method according to embodiments of the invention may initially receive an image (650), identify the pill (655), and then proceed to perform other steps, such as authenticating (645) and reminding.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An apparatus comprising:

a housing attachable to a blister pack;

at least one sensor including at least one camera attached to the housing and positioned to sense removal of a pill from an attached blister pack; and a controller configured to:

determine a timing parameter for taking a pill;

receive a signal from the at least one sensor, wherein the signal includes at least one image of the attached blister pack captured by the at least one camera;

determine based on the signal whether a pill was removed from the blister pack; and if a pill was not removed from the blister pack within a time period based on the timing parameter, issue to an output unit a reminder signal for taking the pill.

2. The apparatus of claim 1, wherein the output unit includes at least one of: an audio device, a vibrating device, and a light-emitting device.

3. The apparatus of claim 1, wherein the timing parameter is determined based on at least one of: a numbers of pills to be taken in a day, a time of day for taking at least one pill, and a number of pills to be taken in each instance.

4. The apparatus of claim 1 further comprising a communication unit for communicating with a remote device, wherein the output unit is a display of the remote device, and wherein the controller is configured to send the reminder signal to the remote device, and wherein the controller is configured to receive the timing parameter from the remote device.

5. The apparatus of claim 1 wherein the at least one sensor comprises a first camera positioned to capture an image of the pills on one side of the attached blister pack and a second camera positioned to capture an image of a tearable foil on a second side of the blister pack.

6. The apparatus of claim 1, wherein the at least one sensor includes a device for sensing disconnection in one or more conducting lines attached to a tearable foil of the blister, and wherein the signal indicate disconnecting of at least one electrical circuit.

7. An apparatus comprising:

a housing attachable to a blister pack;

at least one sensor attached to the housing and positioned to sense removal of a pill from an attached blister pack; and a controller configured to:

determine a timing parameter for taking a pill;

receive a signal from the at least one sensor;

determine based on the signal whether a pill was removed from the blister pack;

if a pill was not removed from the blister pack within a time period based on the timing parameter, issue to an output unit a reminder signal for taking the pill; and receive an initiation signal, wherein receiving the initiation signal is upon attachment of the apparatus to the pill blister, and wherein the initiation signal is an image of the blister received from a camera; and determine the timing parameter also based on the initiation signal.

8. A method, comprising:

determining a timing parameter for taking a pill;

receiving from at least one sensor a signal, the at least one sensor including at least one camera and being positioned to sense removal of a pill from a blister pack, wherein the signal includes at least one image of the attached blister pack captured by the at least one camera;

determining based on the signal if a pill was removed from the blister pack; and if a pill was not removed from the blister pack within a time period based on the timing parameter, issuing to an output unit a reminder signal for taking the pill.

9. The method of claim 8, wherein the timing parameter is determined based on at least: a numbers of pills to be taken in a day, a time in the day for taking at least one pill and a number of pills to be taken each time.

10. The method of claim 8, further comprising:

receiving pill-related data, wherein determining the timing parameter is based on the pill-related data, wherein the pill-related data is received from at least one of: a remote device, a database, and a readable element associated with the blister pack.

11. The method of claim 8, comprising:

receiving user-related data, wherein determining the timing parameter is based on the user-related data, wherein the user-related data is received from at least one of: a remote device and a database.

12. The method of claim 8, wherein the reminder signal is selected from a group consisting of: audio signal, light signal, a vibration, and a notification on a display of a remote device.

13. The method of claim 8, further comprising:

receiving from a database two or more historical signals indicating the removal of pills from a blister pack by a user, including the respective historical times associated with the removals, wherein determining the timing parameter is based on the received two or more historical signals.

14. The method of claim 8, further comprising:

identifying a misuse of the pills; and issuing a misuse alert, wherein issuing a misuse alert comprises at least one of: sending a notification to a user, sending a notification to a caregiver of the user, sending a notification to a relative of the user, and sending a notification to a healthcare organization.

15. The method of claim 8, further comprising:

receiving an authentication signal from a sensor; and authenticating the blister pack based on the authentication signal.

16. The method of claim 8, further comprising:

receiving an image of a tearable foil of the blister pack from a camera; and identifying the type of pills in the blister pack based on the received image.

17. A system, comprising:

a processing unit configured to:

determine a timing parameter for taking a pill;

receive over a network a signal from at least one remote sensor, wherein the at least one remote sensor includes at least one camera and is positioned to sense removal of a pill from a blister pack, and wherein the signal includes at least one image of the attached blister pack captured by the at least one camera;

determine based on the signal whether a pill was removed from the blister pack; and if a pill was not removed from the blister pack within a time period based on the timing parameter, issue to an output unit a reminder signal for taking the pill.

18. The system of claim 17, wherein the timing parameter is determined based on at least one of: a numbers of pills to be taken in a day, a time in the day for taking at least one pill, and a number of pills to be taken in each instance.

19. The system of claim 17, wherein the processing unit is further configured to:

receive user-related data, wherein the user-related data is received from at least one of: a remote device and a database; and determine the time interval for taking the second pill based on the user-related data.

20. The system of claim 17, wherein the processing unit is further configured to:

identify a misuse of the pills; and issue a misuse alert, wherein the processing unit is further configured to issue a misuse alert by at least one of the following: sending a notification to a user, sending a notification to a caregiver of the user, sending a notification to a relative of the user, and sending a notification to a healthcare organization.

21. The system of claim 17, wherein the processing unit is further configured to:

receive an image of a tearable foil of the blister pack from a camera; and identify the type of pills in the blister pack based on the received image.

* * * * *